United States Patent [19]

Cottrell

[11] 4,362,151

[45] Dec. 7, 1982

[54] TRACTION METHOD

[76] Inventor: George W. Cottrell, #10, 2455 NW. Marshall, Portland, Oreg. 97210

[21] Appl. No.: 228,366

[22] Filed: Jan. 26, 1981

[51] Int. Cl.[3] ..... A61H 1/02

[52] U.S. Cl. ..... 128/75; 128/69

[58] Field of Search ..... 128/69, 75; 272/209, 272/120, 142, 121

[56] References Cited

U.S. PATENT DOCUMENTS

| | | | |
|---|---|---|---|
| 1,734,238 | 11/1929 | Sweeney | 128/69 |
| 2,893,384 | 7/1959 | Chick | 128/75 |
| 3,399,888 | 9/1968 | Jensen | 272/20 |
| 3,800,787 | 4/1978 | Rush | 128/75 |
| 4,125,257 | 11/1978 | Lew | 128/75 |

FOREIGN PATENT DOCUMENTS

| | | | |
|---|---|---|---|
| 810930 | 4/1969 | Canada | 128/75 |
| 829380 | 11/1937 | France | 128/75 |
| 1429430 | 1/1965 | France | 128/75 |

*Primary Examiner*—Richard C. Pinkham
*Assistant Examiner*—T. Brown
*Attorney, Agent, or Firm*—Kolisch, Hartwell & Dickinson

[57] ABSTRACT

A traction method for producing flattening of the lumbar spine to overcome anatomical lordosis. A method is disclosed wherein the buttocks of a patient are cradled and lifted so that the patient's own weight provides a traction force.

6 Claims, 4 Drawing Figures

TRACTION METHOD

This invention relates to a traction method, and more particularly, to a traction method which is effective to tend to flatten the lumbar spine so as to overcome anatomical lordosis or abnormal forward curvature of the lower spine.

A persistant problem plaguing civilized man involves pain in the lower back. Such may arise for a number of reasons, but a common cause for such pain is excessive forward curvature of the lumbar in the spine which produces pressure in the posterior portions of the intervertebral discs and pinching off of the space for nerve roots in the intervertebral foramina.

Various methods have been proposed in the past for dealing with the problem, such as prescribing bed rest in a flexed position, the use of various types of flexion casts and braces, and the use of oblique pelvic traction. The procedures enumerated have not been entirely successful. Many procedures are not truly effective in substantially reducing pain. The devices used to produce traction are uncomfortable to the patient, or are so complicated in construction and cumbersome that they are suitable primarily for hospital use and do not lend themselves for use by a patient during bed rest at home.

A general object of this invention is to provide a tractive method which overcomes many of the deficiencies characterizing prior known approaches.

More specifically, an object of the invention is to provide a traction method for flexing the lumbar spine, so as to tend to overcome anatomical lordosis, which utilizes means effective to lift the buttocks of a patient in such a manner that the patient's body weight provides the force tending to straighten the lumbar spine.

Another object is to provide such a method which involves positioning the patient in a supine position on a support, and with means passing downwardly between the patient's legs and then around the coccyx of the patient to an attachment with the patient's torso, lifting and maintaining the pelvis of the patient in a position which is at least partially free of the support, whereby the weight of the patient's lower torso tends to flatten the lumbar spine.

In a preferred embodiment of the invention, the method contemplates encircling the abdominal area and buttocks of the patient with a restraining device, and with the patient lying in a supine position on a support, a lifting force is applied through said restraining device at a region of the device located toward the knees of the patient from the zones where the patient's femurs articulate with the patient's pelvis. With the patient's lower torso lifted in this manner, the weight of the patient tends to curve the lumbar spine in a direction opposite to the curvature of lordosis. In addition, in the preferred embodiment invention, the lower legs of the patient are maintained at an elevation approximating the elevation of the patient's knees. This is effective to relieve what otherwise would be uncomfortable bending at the knees of the patient's legs.

These and other objects and advantages are obtained by the invention, which is described hereinbelow in conjunction with the accompanying drawings wherein.

Figure 3:
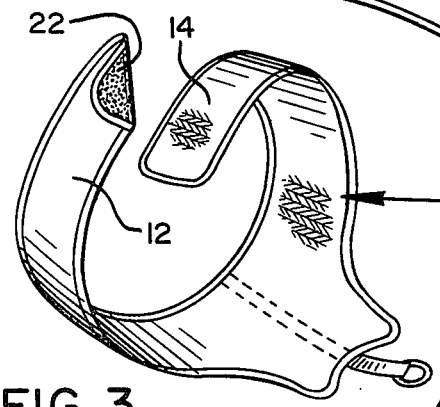
Figure 4:
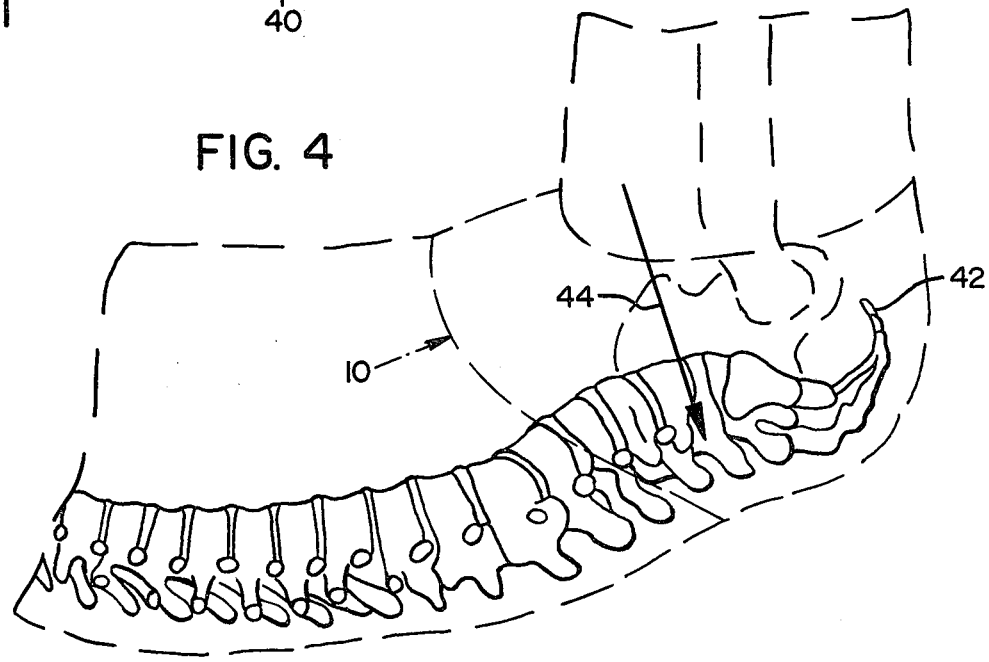

FIG. 3 is a perspective view illustrating how arms in the restraining device may be brought together, as when the device is utilized in encircling the abdominal region and buttocks of a patient; and FIG. 4 is a view illustrating in dashed outline the abdomen and buttocks of a patient, and in solid outline the lower spine of the patient, and showing how the lumbar spine tends to flatten with the buttocks of the patient lifted.

As contemplated by a preferred embodiment of the invention, a restraining device is attached around the abdominal area and buttocks of a patient, and using such device, with the patient in a supine position in a support, the buttocks of the patient are lifted from the support. The restraining device may be constructed as illustrated in FIGS. 2 and 3.

Figure 2:
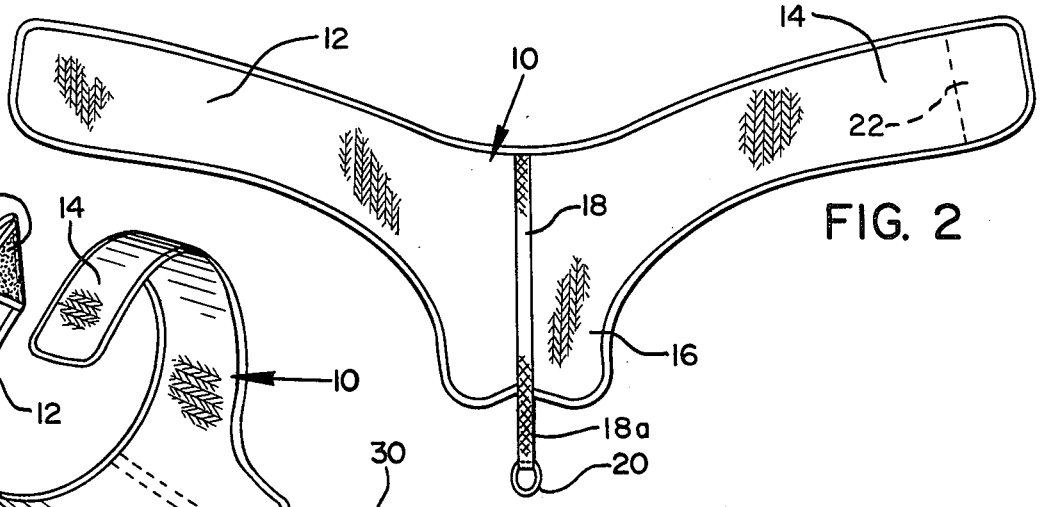
FIG. 2 is a plan view of a restraining device which may be utilized in producing the traction force contemplated.

Briefly, and referring to these figures, the restraining device comprises a sheet-like flexible body 10, shaped to have, as illustrated in FIG. 2, elongate arm expanses 12, 14, and a central, laterally projecting expanse 16. The body may be made as a reinforced pad, so as to have the proper strength and so as to be comfortable when attached in an encompassing position about the patient. A belt 18 joined to the body and overlying projecting expanse 16 has an end **18*a* attached to a ring 20**. As will be described, the ring is employed in attaching a line used in applying a lifting force.

Figure 1:
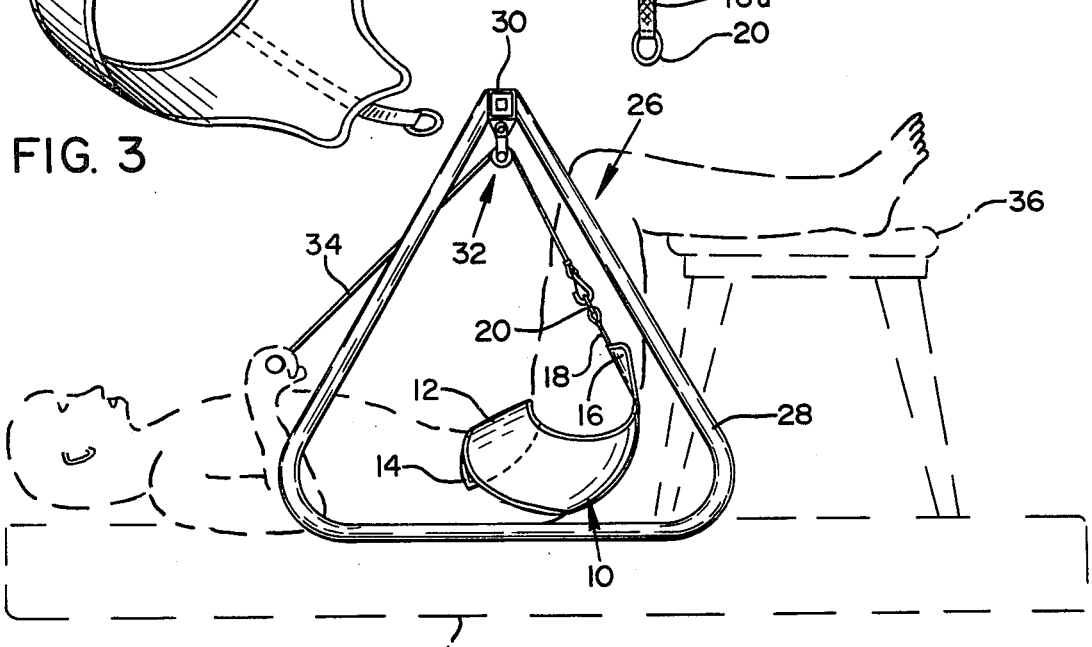
FIG. 1 is a view showing, in side elevation, a patient lying in a supine position on a support, with the patient's buttocks and lower legs raised as contemplated by the traction method herein.

When the device is applied to a patient, as illustrated in FIG. 1, the arm expanses are placed in a position overlapping each other, and provision is then made for attaching the arm expanses. This attachment may be done in a number of ways. A convenient construction is to provide on the inner side of arm expanse 12 a surface 22 which, when pressed against the back of arm expanse 14, will remain attached thereto. Illustrative of such a fastening system is the hook and loop assemblage which is pressed together to form an attachment sold under the trademark VELCRO produced by American Velcro, Inc.

Also useful in practicing the method of the invention is a portable stand, such as that shown generally at 26. Stand 26 may include a pair of opposed side frames, such as the frame shown at 28, made for instance, of tubular material, and approximating a triangular outline. The frames are placed with one frame on one side of the patient and one on the other side of the patient (one frame is obscurred in FIG. 1). Interconnecting the frames is a crosspiece 30 joined to the two frames in such a manner as to produce a rigid structure of the assemblage of frames and crosspiece.

Dependently supported from the crosspiece, intermediate the ends of the crosspiece, is a pulley assembly 32 which is adapted to have a line such as line 34 trained thereover. The assembly may be provided with a locking tab (not shown) of the type found in window shades and screen constructions, which permits the line to be moved over the pulley freely in one direction, as from right to left in FIG. 1, but which is actuatable to prevent reverse movement of the line by reason of the tab wedging against the line.

Preferably included in practicing the method of the invention is the support exemplified by the stool shown in 36 upon which the patient may rest his lower legs in an elevated position, i.e., substantially as the elevation of his knees, while receiving traction pursuant to the invention.

In practicing the invention, the patient lies in a supine position on a support such as the bed support partially shown at 40. The restraining device is placed about the patient as shown in FIG. 1, with the arms overlapping each other and with the device encircling the abdominal area and buttocks of the patient. Central projecting expanse 16 is positioned between the patient's legs and line 34 attached thereto, as by locking an end of the line onto ring 20. The patient, or an attendant, as the case may be, may then pull on the line to lift the patient through the restraining device at a region of the device located toward the knees of the patient from where the patient's femurs articulate with the patient's pelvis. Lifting is continued, preferably until the buttocks are fully raised from the bed. The line is then locked in position and the patient then remains with his lower torso maintained in this elevated position. To permit the legs to be partially unfolded, the lower legs are rested on the stool 36, with lower legs at substantially the elevation of the knees.

With such positioning of the patient, the means which applies a lifting force, in effect, extends down between the patient's legs and thence around the coccyx 42 of the patient's spine to an attachment with the patient, as illustrated in FIG. 4. The suspended weight of the patient tends to exert a force downwardly on the spine, as indicated by the arrow 44, which flexes the lumbar spine in a direction tending to flatten it. This is opposite to the direction of the curvature of lordosis, which is convex forward curvature of the lower spine.

With traction produced as indicated, and because of such flexing of the lumbar spine, pressure is relieved on the posterior parts of the intervertebral discs. More room is provided for the nerve roots in the intervertebral foramina. Most patients subjected to the traction experience immediate, substantial relief of pain.

Unique features of the method include the subjection of a traction force resulting from cradling and lifting of the buttocks, and the use of the patient's own weight to provide the traction force. The method contemplated is extremely simple, and involves relatively inexpensive equipment. As a consequence, it serves as a basis for a simple, effective, inexpensive treatment for a painful lower back. A patient instructed as to how to carry out the method becomes involved in a meaningful way in producing the traction, in a manner which the patient understands. In those instances where reversing the lumbar lordotic curve is not effective materially to relieve back pain, use of the method immediately makes this evident.

It is claimed and desired to be secured by Letters Patent:

1. A method of treating a human patient to apply traction force to the lumbar spine operable to overcome anatomical lordosis comprising:

encircling the abdominal area and buttocks of the patient with a restraining device, positioning the patient in a supine position on a support, and lifting and holding the patient through said restraining device, at a region of the device located on the under or buttocks side of the patient with the patient supine and toward the knees of the patient from the zones where the patient's femurs articulate with the patient's pelvis, whereby the weight of the patient forces curvature of the patient's lumbar spine in a direction opposite to the curvature of lordosis.

2. The method of claim 1, wherein lifting and holding is performed with pulling upwardly on the restraining device with means passing between the patient's legs.

3. The method of claim 1, wherein during holding of the patient, the lower legs of the patient are maintained at an elevation approximating the elevation of the patient's knees.

4. The method of claim 1, wherein lifting and holding is performed with pulling upwardly on the restraining device through means passing between the patient's legs, and wherein during holding of the patient the lower legs of the patient are maintained at an elevation approximating the elevation of the patient knees.

5. The method of applying traction to the lumbar spine of a patient comprising:

positioning the patient in a supine position on a support, and with means passing downwardly between the patient's legs and thence under the coccyx of the patient to an attachment with the patient's torso, maintaining the pelvis of the patient in a position at least partially lifted from said support, whereby the weight of the patient tends to curve the patient's lumbar spine in a direction opposite to the curvature of lordosis.

6. The method of claim 5, wherein, simultaneously with maintaining the pelvis of the patient in a position at least partially lifted from said support, the lower legs of the patient are maintained at an elevation approximating the elevation of the patient's knees.

* * * * *